United States Patent [19]

Uemura et al.

[11] Patent Number: 4,934,448

[45] Date of Patent: Jun. 19, 1990

[54] ROTARY HEAT EXCHANGER

[75] Inventors: Masakazu Uemura, Yokosuka; Yoshinori Hirano, Yokohama; Hitoshi Shimonosono, Yokosuka, all of Japan

[73] Assignee: Nissan Motor Co., Ltd., Japan

[21] Appl. No.: 305,773

[22] Filed: Feb. 3, 1989

[30] Foreign Application Priority Data

Feb. 9, 1988 [JP] Japan ..... 63-15164[U]

[51] Int. Cl.[5] ..... F01P 3/18; F28F 5/04

[52] U.S. Cl. ..... 165/41; 165/51; 165/92; 165/121

[58] Field of Search ..... 165/41, 51, 86, 92, 165/121

[56] References Cited

U.S. PATENT DOCUMENTS

| | | | |
|---|---|---|---|
| 3,424,234 | 1/1969 | Laing | 165/89 |
| 3,800,865 | 4/1974 | Onarheim et al. | 165/92 |
| 4,301,860 | 11/1981 | Pozzi | 165/90 |
| 4,621,684 | 11/1986 | Delahunty | 165/92 |
| 4,706,615 | 11/1987 | Scadding | 123/41.01 |

FOREIGN PATENT DOCUMENTS

| | | | |
|---|---|---|---|
| 58-224296 | 12/1983 | Japan | 165/86 |
| 59-41111 | 10/1984 | Japan . | |
| 60-23277 | 6/1985 | Japan . | |

*Primary Examiner*—Martin P. Schwadron
*Assistant Examiner*—Allen J. Flanigan
*Attorney, Agent, or Firm*—Leydig, Voit & Mayer

[57] ABSTRACT

A rotary heat exchanger comprises a plurality of hollow disc shaped members which are arranged along a distribution conduit and are rotatable about an axis which is concentric with the axis of the distribution circuit. Two diametrically opposed exhaust conduits fluidly interconnect the disc members at locations proximate their peripheries. Bearings and seals are arranged next to one another along inlet and exhaust pipes so that the bearings protect the seals from damage during rotation of the heat exchanger.

14 Claims, 5 Drawing Sheets

ROTARY HEAT EXCHANGER

BACKGROUND OF THE INVENTION

Field of the Invention

The present invention relates to a rotary heat exchanger and more specifically to a rotary heat exchanger which exhibits good heat exchange characteristics and an improved leakproof seal construction.

DESCRIPTION OF THE PRIOR ART

JP-B-59-41111 and JP-B-60-23277 disclose rotatary heat exchangers of nature shown in FIGS. 1 and 2. This type of device includes an inlet port 1 via which fluid F is supplied into a supply chamber 2. A seal arrangement 3 supports a supply conduit 4 in a manner wherein the upstream end thereof is placed in fluid communication with the supply chamber 2. The downstream end of the supply conduit communicates with an essentially annular rotatable header 5. A plurality of hollow blower blades are arranged to establish fluid communication between the outer peripheral portion of the supply header and the corresponding portion of a rotatable exhaust header 7. An exhaust conduit 8 is arranged to communicate at its upstream end with exhaust header and to be rotatably supported by way of seal arrangements 9 and 10 in a exhaust chamber 11. The portion of the exhaust conduit defined between the two seal arrangements 9 and 10 is apertured in a manner wherein the fluid which is supplied into the exhaust header can be discharged into the exhaust chamber 11 and subsequently drained therefrom via an outlet conduit 12.

The hollow blower blades 6 are provided with a plurality fins 13 which improve the heat exchange efficiency of the arrangement. A motor 14 is operatively connected to an end portion of the exhaust conduit 8. When this motor is energized the rotatary headers and interconnecting hollow blower blades are induced to rotate in a manner to define a rotary type blower arrangement.

However, this arrangement suffers from the drawback that both the fins 13 which are formed either in the form of circular or annular plates and the shaped hollow blower blades must be very carefully formed and assembled in order to achieve a good fit and the required balance of the rotating parts.

This of course renders the manufacture and assembly of the same both difficult and time consuming and increases the cost of the device undesirably.

In addition to this, the seal arrangements 3, 9 and 10 which are provided in order to prevent leakage of the fluid which is circulated through the device and subject to cooling, are subject to vibration and radial forces due to the inevitable slight imbalance in the rotating parts of the device and tend to readily readily deteriorate to the point of permitting leakage to occur.

SUMMARY OF THE INVENTION

It is an object of the present invention to provide a rotary heat exchanger which can be readily and economically manufactured and which has a durable bearing/seal construction which ensures smooth rotation and protects the seals from vibrational forces and the like in a manner which ensures the longevity of the same.

In brief, the above object is achieved by an arrangement which features plurality of hollow disc shaped members which are arranged along a distribution conduit and arranged to be rotatable about an axis which is concentric with the axis of the distribution conduit. A plurality of exhaust conduits are arranged to fluidly interconnect the disc members at locations proximate their peripheries. Structures which define inlet and outlet chambers include bearings and seals which are arranged in parallel so that the bearings protect the seals from damage during rotation of the device.

More specifically, a first aspect of the present invention is deemed to comprise a rotary heat exchanger which features: a distribution conduit, said distribution pipe being arranged to be coaxial with an axis of rotation of said rotary heat exchanger, said distribution conduit having a open end and a closed end, said open end being arranged to be supplied with fluid; a plurality of hollow annular disc members, said hollow disc members being arranged to communicate at their inner peripery with said distribution pipe in a manner wherein the fluid which is supplied into said distribution pipe flows radially outward therethrough; and a plurality of exhaust conduits, said exhaust conduits being arranged to fluidly interconnect said annular disc members at locations proximate the outer peripheries thereof.

A second aspect of the invention is deemed to comprise a rotary heat exchanger which features: a distribution conduit, said distribution pipe being arranged to be coaxial with an axis of rotation of said rotary heat exchanger, said distribution conduit having a open end and a closed end; a plurality of hollow annular disc members, said hollow disc members being arranged to communicate at their inner peripery with said distribution pipe; a plurality of exhaust conduits, said exhaust conduits being arranged to fluidly interconnect said annular disc members at locations proximate the outer peripheries thereof; first and second end plates, said first and second end plates each having a dished configuration, said first end plate having an opening in which said open end of distribution pipe is received, said second end plate having a plurality of openings in which said plurality of exhaust conduits are received; first and second covers, said first and second covers being arranged with said first and second end plates to define first and second enclosed spaces therebetween; first and second plates, said first and second plates being arranged to partition said first and second enclosed spaces and to define an inlet chamber in said first space and an outlet chamber in said second space, said first and second plates being formed with first and second bores, respectively, said first bore being arranged to receive a portion of said inlet pipe arrangement and said second bore being arranged to receive a portion of said outlet pipe arrangement, said inlet chamber fluidly communicating with both of said distribution conduit and said inlet pipe so that fluid introduced thereinto from said inlet pipe can be transferred into said distribution pipe, said outlet chamber being arranged to fluidly communicate with said exhaust conduits and said outlet pipe in manner that the fluid discharged thereinto from said exhaust conduits can transferred into said outlet pipe arrangement; first and second bearings, said first bearing being disposed beween and operatively interconnecting said first cover and said inlet pipe arrangement in a manner wherein said cover is rotatably supported on said inlet pipe arrangement so as to be rotatable about said axis, said second bearing being disposed between and opertively interconnecting said second cover and said outlet pipe arrangement in a manner wherein said second cover is rotatably supported on said outlet pipe arrangement so as to be rotatable about said axis; and first and second seal arrangements, said first and second seal arrangements being disposed on said inlet and outlet pipe arrangements respectively, said first and second seal arrangements being arranged to prevent leakage of fluid from said inlet and outlet chambers via said first and second bores.

A third aspect of the present invention is deemed to comprise an automotive vehicle which comprises: an engine compartment; an engine disposed in said engine room; a rotary heat exchanger disposed in said engine room; a duct disposed about said rotary heat exchanger, said duct having an inlet which is arranged to be exposed to a source of ram pressure which induces air to flow therethrough when said vehicle is moving, said duct and an outlet, which discharges the air which passes through the duct in a manner wherein it does not contact the engine.

DETAILED DESCRIPTION OF THE PREFERRED EMBODIMENTS

Figure 3:
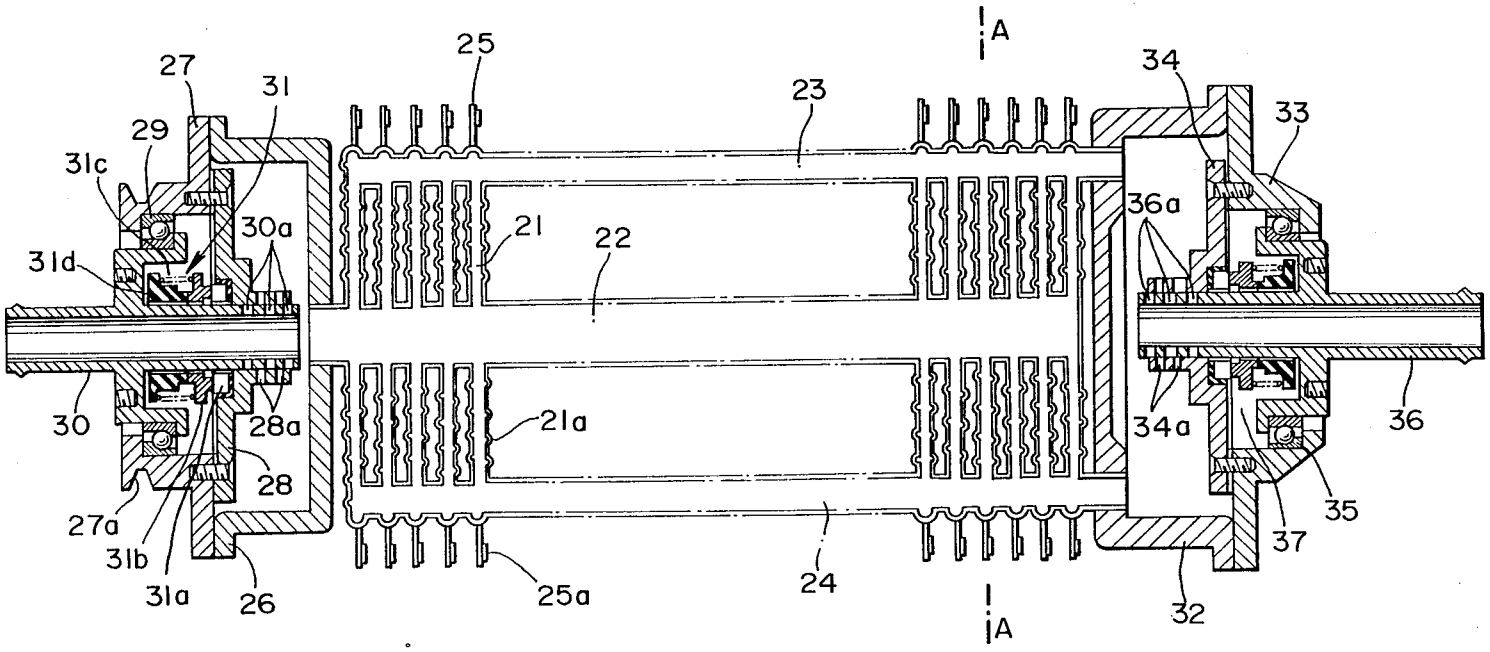
FIG. 3 is a sectional elevation showing the construction and arrangement of a first embodiment of the present invention.
Figure 4:
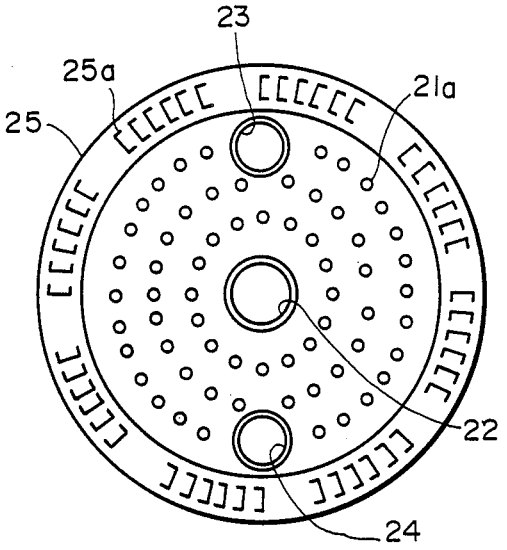
FIG. 4 is a sectional side elevation taken along section line IV—IV of FIG. 3.

FIGS. 3 and 4 shows a first embodiment of the present invention. In this arrangement a plurality of hollow disc-shaped members 21 are mounted concentrically on a distribution pipe or conduit 22 and arranged to each fluidly communicate therewith.

The outer peripheral sections of the disc members 21 are in fluid communication with one another by way of exhaust conduits 23 and 24. As will be appreciated from FIG. 4, the exhaust conduits extend essentially parallel to the distribution conduit 22 and are located diametrically opposite to and equidistant therefrom.

In this arrangement, a plurality of small, convex, essentially hemispherical projections 21*a* are formed on each of the lateral surfaces of the disc members 21 in the manner shown in FIG. 4. A plurality of louver-like members 25*a* are formed on a radially acting fin 25 which extends from the outer periphery of each of the disc members. These louver members 25*a* are designed to act as air agitation means which promote the flow of air over the surfaces of the hollow disc members 21 and interconnecting conduits and to simultaneously release to the air heat which is conducted to the disc members and conduits.

A first dished annular end plate 26 is fixedly connected to the upstream end of distribution conduit 22 cooperate with a cover 27 which is secured thereto to define an enclosed space. A circular plate 28 having a central boss portion in which a coaxial through bore is formed is disposed in the enclosed space and secured to the inboard face of the cover 27 via by suitable means such as screws. A suitable sealing gasket is interposed between the cover 27 and the plate 28 in a manner to provide a fluid tight seal and thus define a supply or inlet chamber within the end plate 26.

A bearing 29 such as a roller bearing is operatively disposed between the cover 27 and an annular flange portion formed on an inlet pipe arrangement 30. This arrangement is fixedly supported on a stationary member such as a vehicle chassis or the like.

The downstream end of the inlet pipe arrangement 30 is received in a bore formed in the circular plate 28 in the manner shown in FIG. 4. This portion of the inlet pipe 30 is formed with a plurality of diameter radial bores 30*a*. The boss portion is also formed with a plurality of radial bores 28*a* which are offset from those formed in the inlet pipe 30.

The radial bores 28*a* and 30*a* to ensure the maintenance of a layer of liquid between the surfaces of the inlet pipe and the bore which are in bearing contact with one. The layer other and thus provides a kind of lubrication.

The cover 27 is further formed with a V-shaped groove 27*a* about the outer periphery thereof which receives a V-belt which is drivingly connected with the crankshaft of the engine or similar source of rotational energy.

A mechanical seal 31 is disposed on the section of the inlet pipe arrangement located between the plate and the inboard surface of the annular flange on which the bearing 29 is supported. This seal includes a floating seal member 31*a*, a carbon seal 31*b*, a spring 31*c* and a shaft seal 31*d*. The annular floating seal member 31*a* is disposed in an annular recess formed in the outboard face of the plate 25. The carbon seal 31*b* is arranged about the outboard edge of the floating seal member shaft seal 31*d* at the other end.

A second dished end plate 32 communicates with the downstream ends of the exhaust conduits 23 and 24. A cover 33 and circular plate 34 which are essentially the same as elements 27 and 28, cooperate with an outlet pipe arrangement 36 to define an exhaust chamber.

A roller bearing 35, and a seal arrangement are disposed with respect to the cover 33 and circular plate 34 in a manner essentially the same as that described in connection with the inlet pipe end of the arrangement.

Figure 5:
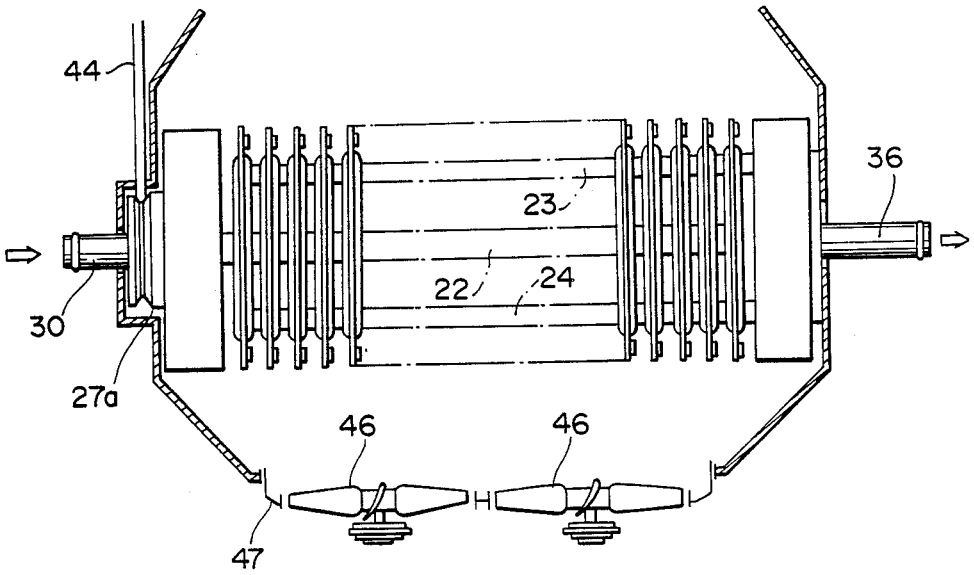
FIG. 5 is plan view showing a the first embodiment of the present invention enclosed in a housing equipped with two cooling fans.
Figure 6:
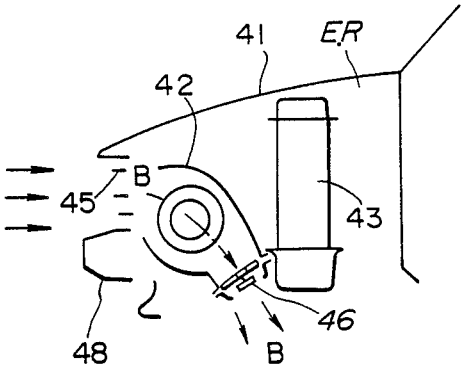
FIG. 6 is a schematic side elevation showing a ducting arrangement in which the embodiments of the invention can be utilized.

FIGS. 5 and 6 show the above arrangement as applied to an automotive cooling system. FIG. 6 shows the system schematically. In these figures, the numeral 41 denotes a engine hood, 42 a duct in which the rotatary heat exchanger according to the first embodiment of the present invention is disposed, 43 is an engine which in is transversely mounted in an engine compartment 49, 44 denotes a V-belt which provides a drive connection between the cover 27 and a source of rotational energy such as the crankshaft of the engine, an electric motor, or the like, 45 denotes a radiator grill or similar apertured arrangement via which air can flow into the engine compartment and duct 42, 46 denote fans which are arranged at the downstream end of the duct 42, 47 denotes an air outlet cover which cooperate with the two fans 46, and 48 denotes a bumper.

Although not shown, the ends of the inlet and outlet pipes are connected by hoses to the engine coolant jacket and/or other devices included in the cooling system.

The operation of the system is such that the hot coolant from the engine is pumped to the inlet pipe arrangement 30 from where it flows into the inlet chamber and into the distribution conduit 22. From the distribution conduit the hot coolant flows radially outward through the hollow disc members 21 and into the two exhaust conduits 23, 24. The effluent from the exhaust conduits 23, 24 is subsequently discharged into the exhaust chamber and therefrom into the exhaust pipe arrangement 36. During this time the hollow disc members are being rotated in a manner which promotes the release of heat to the air flowing over the surfaces thereof. It will be appreciated that the portions of the distribution conduit 22 and the exhaust conduits which extend between the disc members 21 are also exposed to the flow of air and also release heat thereto. To a lesser degree, heat is also lost from the end plates and covers which are also rotating and therefore act as heat exchanging members. The hemispherical projections 21*a* also add to the amount of heat which is released from the surfaces of the disc members.

Figure 1:
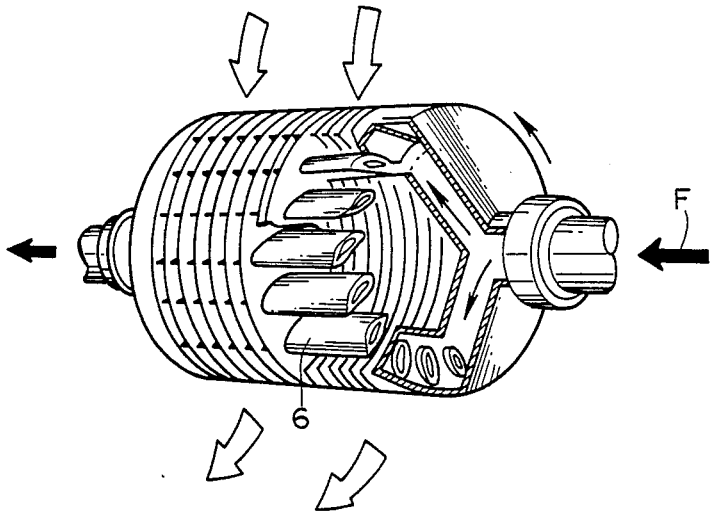
FIG. 1 (PRIOR ART)
FIG. 1 is a cut-away perspective view showing the prior art arrangement discussed in the opening paragraphs of the instant disclosure.
Figure 2:
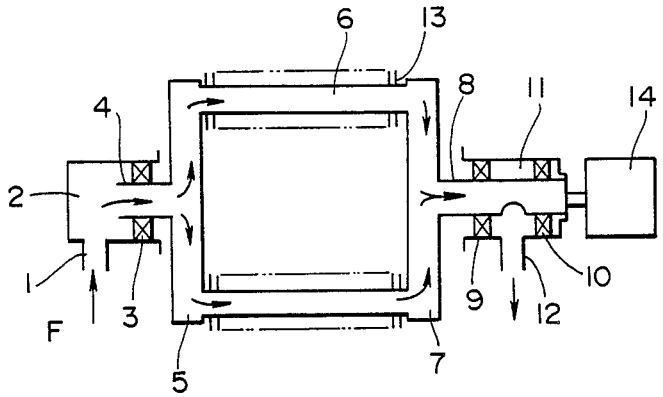
FIG. 2 (PRIOR ART)
FIG. 2 is a schematic elevation of the arrangement shown in FIG. 1.

It will be noted that with the instant embodiment the amount of surface area avaiable for heat exchange is much greater than in the case of the prior art arrangement shown in FIG. 1.

With the arrangement shown in FIGS. 5 and 6, the problem wherein there is a limit to the number of fins which can provided on the device in order to avoid a loss of blowing action is overcome via the provision of the two fans 46. These devices are driven by selectively energizable electric motors and thus enable selective control of the amount of air which is caused to flow over the heat exchanging surfaces of the rotating elements. Accordingly, during cold weather and the like, the fans can be de-energized to obviate uncessary power usage and noise generation.

The combination of the fans 46, the louvers 25*a* and the hemispherical projections 21*a* provide sufficient air flow and air agitation between the disc members to disturb the layer of air which tends to form between the air and metal surface interface, and therefore promote and increase in the heat exchanging efficiency of the device. In addition, the ramming effect with which air from radiator grill 45 enters the duct 42 adds to the flow over the heat exchanging surfaces and reduces the load on the fans 46.

A further advantage derived with the arrangement illustrated in FIGS. 5 and 6 is that the heat which is released from the rotary heat exchanger according to the present invention is exhausted directly from the engine room and. This avoids the problem of conventional heat exchanges in which the flow of hot air tends to flow from the heat exchanger onto the engine and impedes the the cooling of the engine, whereby the purpose of the heat exchanger or radiator is defeated. Accordingly, the air which in this arrangement actually flows over the engine and associated components is essentially at ambient temperatures and therefore is able to much more readily remove heat from elements such as drive belts, rubber hoses and the like which are susceptible to high temperatures.

It should be noted that the locations of the heat exchanger and the arrangement of the duct 42 is not limited to the illustrated arrangements. By way of example, it is possible to place the heat exchanger behind the engine at a relatively low level and arrange the duct to extend from the air box located immediately in front of the windshield down around the heat exchanger. With this arrangement, the high pressure which develops in front of the windshield can be use to ram air down over the heat exchanger and thus avoid the undesirable flow of heated air from heat exchanger over the engine.

As a further alternative the duct can be arranged to induct air from below the vehicle, pass it over the heat exchanger and discharge the hot effluent back under the vehicle at a location downstream of the induction area.

Various modifications and changes to the location and arrangement of duct can be easily made by those skilled in the automotive art and description of further alternative arrangements will be omitted for the sake of brevity.

As a heat exchanger according to the present invention is in the form of an elongate cylinder, it is possible to lower the hood at the front of the vehicle to a much greater extent than in the case of conventional stationary, upright radiators which must be disposed at the front of the vehicle engine. Accordingly, improvements in front end design and reduced air resistance and drag characteristics are rendered possible.

Figure 8:
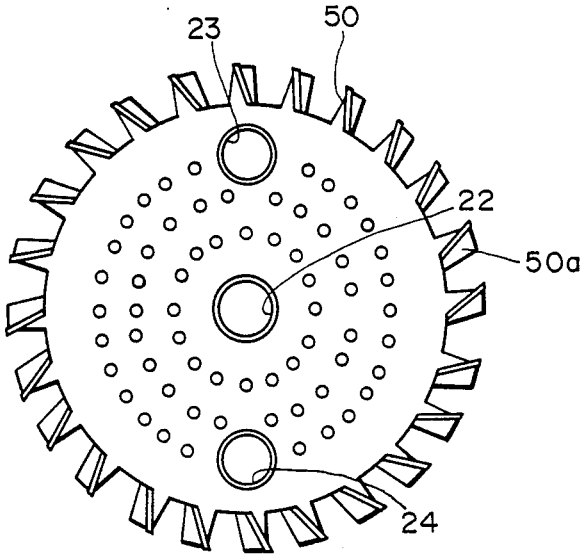
FIGS. 7 and 8 show a second embodiment of the present invention.
Figure 7:
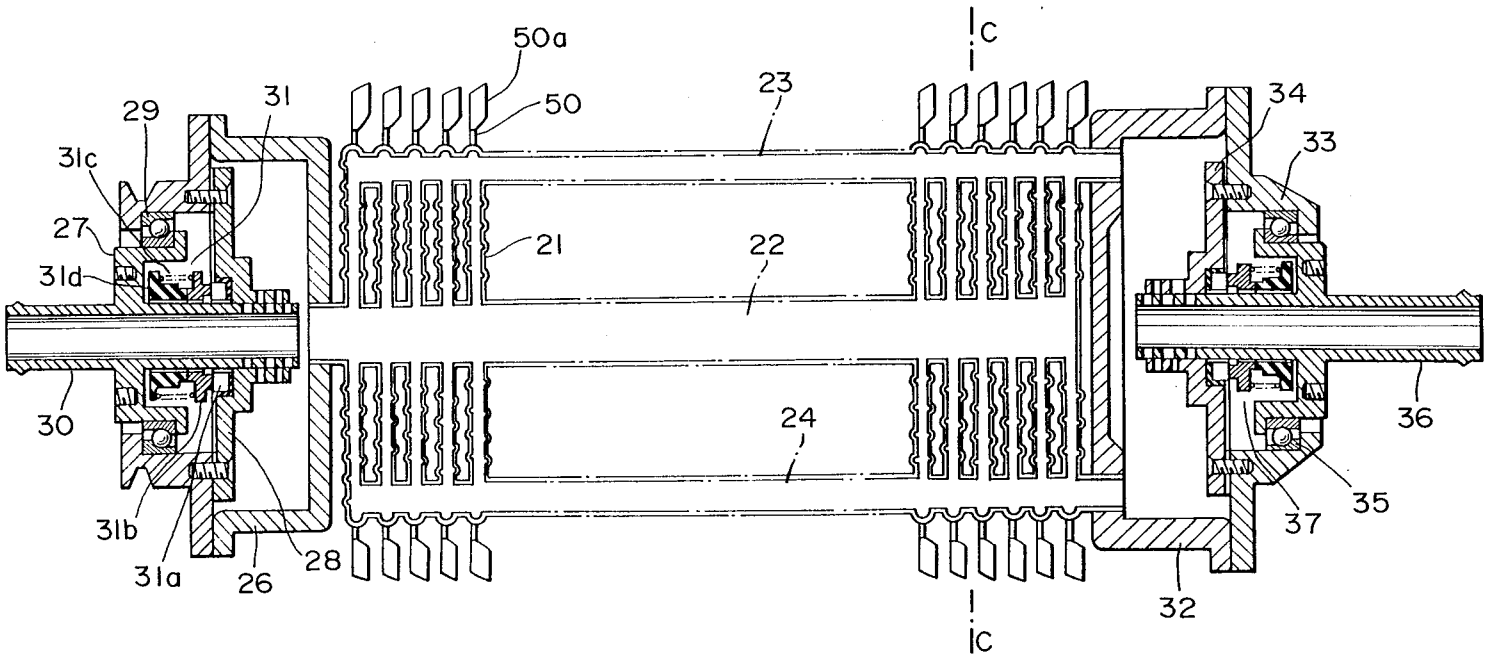

FIGS. 7 and 8 show a second embodiment of the present invention. In this arrangement the annular fin and louver arrangement of the first embodiment (see FIG. 4) is replaced by an arrangement wherein fins 50 are each formed with a plurality of L-shaped cuts and bent to form fan blades 50*a*. As the surface area of these blades 50*a* is slightly larger than that of the louvers 25*a*, an increased amount of air movement is induced.

What is claimed is:

1. An arrangement for a rotary heat exchanger having a longitudinal axis of rotation comprising:

a distribution pipe which is coaxial with the axis of rotation of the rotary heat exchanger and which has an open end and a closed end;

a plurality of hollow annular members which are spaced from one another in the longitudinal direction of said distribution pipe, each of said annular members communicating at its inner periphery with the inside of said distribution pipe; and a plurality of exhaust pipes which fluidly interconnect said annular members near the outer peripheries thereof.

2. An arrangement as claimed in claim 1 further comprising:

a plurality of annular fins disposed on the outer periphery of said annular members and extending radially outward with respect to the longitudinal axis, each of said fins having a plurality of fan blades or louvers.

3. An arrangement as claimed in claim 1 further comprising:

a first rotating body having an inlet chamber formed therein which communicates with the inside of said distribution pipe;

a stationary inlet pipe which fluidly communicates with the inside of said inlet chamber;

a first seal which is disposed inside said first rotating body around said inlet pipe;

a first bearing which is disposed inside said first rotating body radially outwards from said first seal and rotatably supports said first rotating body on said inlet pipe;

a second rotating body having an outlet chamber formed therein which communicates with the inside of one of said exhaust pipes;

a stationary outlet pipe which fluidly communicates with the inside of said outlet chamber;

a second seal which is disposed inside said second rotating body around said outlet pipe; and a second bearing which is disposed inside said second rotating body radially outwards of said second seal and rotatably supports said second rotating body on said outlet pipe.

4. An arrangement as claimed in claim 1 wherein said annular members have a plurality of projections formed on the lateral surfaces thereof.

5. An arrangement as claimed in claim 1 further comprising:

a duct which is disposed about said annular members for guiding a flow of air over said annular members.

6. An arrangement as claimed in claim 5 further including a fan which is mounted on said duct for inducing a flow of air through said duct.

7. A rotary heat exchanger comprising:

a distribution pipe which is coaxial with a longitudinal axis of rotation of said rotary heat exchanger and which has an open end and a closed end;

a plurality of hollow annular members which are spaced from one another along said distribution pipe and communicate at their inner periphery with the inside of said distribution pipe;

a plurality of exhaust pipes which fluidly interconnect said annular members near the outer peripheries thereof;

first and second end plates each having a dished configuration, said first end plate having an opening in which said open end of said distribution pipe is received, said second end plate having a plurality of openings in which said plurality of exhaust pipes are received;

first and second covers which are combined with said first and second end plates to form first and second enclosed spaces therebetween;

a stationary inlet pipe extending into said first enclosed space;

a stationary outlet pipe extending into said second enclosed space;

first and second plates which partition said first and second enclosed spaces and define an inlet chamber in said first space and an outlet chamber in said second space, respectively, said first and second plates being formed with first and second bores, respectively, said first bore receiving a portion of said inlet pipe and said second bore receiving a portion of said outlet pipe, said inlet chamber fluidly communicating with both said distribution pipe and said inlet pipe, said outlet chamber fluidly communicating with said exhaust pipes and said outlet pipe;

first and second bearings, said first bearing being disposed between said first cover and said inlet pipe and rotatably supporting said first cover on said inlet pipe, said second bearing being disposed between said second cover and said outlet pipe and rotatably supporting said second cover on said outlet pipe; and first and second seal arrangements disposed on said inlet and outlet pipes, respectively, to prevent leakage of fluid from said inlet and outlet chambers via said first and second bores.

8. An arrangement as claimed in claim 1 wherein said distribution pipe has a plurality of holes formed therein between said open end and said closed end, and each of said hollow annular members communicates with the inside of said distribution pipe through one of said holes.

9. An arrangement as claimed in claim 3 wherein said first rotating body has a bearing surface which receives said inlet pipe and said second rotating body has a bearing surface which receives said outlet pipe, further comprising lubricating means for lubricating the bearing surfaces of said first and second rotating bodies.

10. An arrangement as claimed in claim 9 wherein said lubricating means comprises:

a lubricating hole formed in said inlet pipe between the inside and the peripheral surface of said inlet pipe;

a lubricating hole formed in said first rotating body between its bearing surface and the inside of said inlet chamber;

a lubricating hole formed in said outlet pipe between the inside and the peripheral surface of said outlet pipe; and a lubricating hole formed in the said second rotating body between its bearing surface and the inside of said outlet chamber.

11. An engine cooling arrangement for an automotive vehicle comprising:

an engine compartment;

an engine disposed in said engine compartment;

a source of ram pressure;

a duct having an inlet which is connected to said source of ram pressure and an outlet which opens in a direction pointing away from said engine;

a substantially cylindrical rotary heat exchanger which is disposed inside said duct and has a longitudinal axis of rotation which extends transversely across the vehicle, the heat exchanger comprising:

a distribution pipe which is coaxial with the axis of rotation and which has an open end and a closed end;

a plurality of hollow annular members which fluidly communicate at their inner periphery with the inside of said distribution pipe;

a plurality of exhaust pipes which fluidly interconnect said annular members near the outer peripheries thereof;

a stationary inlet pipe and a stationary outlet pipe;

a first rotating body having an inlet chamber formed therein which fluidly connects said inlet pipe and said distribution pipe and having a bearing surface which rotatably receives said inlet pipe;

a second rotating body having an outlet chamber formed therein which fluidly connects said outlet pipe with said exhaust pipes and having a bearing surface which rotatably receives said outlet pipe;

a first seal and a first bearing which are disposed inside said first rotating body, said first seal forming a seal around said inlet pipe and said first bearing rotatably supporting said first rotating body on said inlet pipe, said first bearing being disposed radially outwards of said first seal;

a second seal and a second bearing which are disposed inside said second rotating body, said second seal forming a seal around said outlet pipe and said second bearing rotatably supporting said second rotating body on said outlet pipe, said second bearing being disposed radially outwards of said second seal; and lubricating means for lubricating the bearing surfaces of said first and second rotating bodies.

12. An arrangement as claimed in claim 11 wherein said lubricating means comprises:

a lubricating hole formed in said inlet pipe between the inside and the peripheral surface of said inlet pipe;

a lubricating hole formed in said first rotating body between its bearing surface and the inside of said inlet chamber;

a lubricating hole formed in said outlet pipe between the inside and the peripheral surface of said outlet pipe; and a lubricating hole formed in the said second rotating body between its bearing surface and the inside of said outlet chamber.

13. An arrangement as claimed in claim 12 wherein said lubricating holes are offset with respect to one another in the longitudinal direction of said heat exchanger.

14. An arrangement for a rotary heat exchanger having a longitudinal axis of rotation comprising:

a distribution pipe having an open end and a closed end, an axial passage which extends longitudinally between the open and closed ends, and a plurality of radial through holes which open onto said axial passage;

a plurality of hollow annular members which are mounted on and extend substantially perpendicularly from said distribution pipe and are spaced apart from one another in the longitudinal direction of said distribution pipe to define air flow passageways between adjacent annular members, each of said annular members fluidly communicating at its inner periphery with the central passage of said hollow distribution pipe through one of said radial through holes; and a plurality of exhaust pipes which fluidly interconnect said annular members near their outer peripheries.

* * * * *